US008020352B2

(12) United States Patent
Ahearn

(10) Patent No.: US 8,020,352 B2
(45) Date of Patent: Sep. 20, 2011

(54) PULTRUDED WALL FRAMING SYSTEM

(76) Inventor: Roger E. Ahearn, Barnhart, MO (US)

( * ) Notice: Subject to any disclaimer, the term of this patent is extended or adjusted under 35 U.S.C. 154(b) by 1141 days.

(21) Appl. No.: 11/469,649

(22) Filed: Sep. 1, 2006

(65) Prior Publication Data

US 2007/0051059 A1 Mar. 8, 2007

Related U.S. Application Data

(60) Provisional application No. 60/713,780, filed on Sep. 2, 2005.

(51) Int. Cl.
*E04H 6/00* (2006.01)

(52) U.S. Cl. ..... 52/242; 52/241

(58) Field of Classification Search ..... 52/241, 52/242, 220.7, 169.5, 302.3, 293.3, 274, 52/843, 836, 831, 834
See application file for complete search history.

(56) References Cited

U.S. PATENT DOCUMENTS

| | | | | |
|---|---|---|---|---|
| 2,997,141 | A * | 8/1961 | Wetzler | 52/836 |
| 4,619,098 | A * | 10/1986 | Taylor | 52/843 |
| 5,412,919 | A * | 5/1995 | Pellock et al. | 52/656.1 |
| 5,765,329 | A * | 6/1998 | Huang | 52/302.3 |
| 6,199,336 | B1 * | 3/2001 | Poliquin | 52/489.1 |
| 2001/0004825 | A1 * | 6/2001 | Menendez | 52/736.1 |
| 2006/0096200 | A1 * | 5/2006 | Daudet | 52/272 |

* cited by examiner

*Primary Examiner* — Jeanette E Chapman
*Assistant Examiner* — Daniel Kenny
(74) *Attorney, Agent, or Firm* — Charles McCloskey

(57) ABSTRACT

Generally, a structural building system has a header, a header distant from the footer, and a plurality of vertical members spanning the footer and the header. The footer includes two support members, each having a horizontal portion and a vertical portion, positioned in an interior space of the footer for additional strength and stability. The header includes a corrugation, or brace member positioned in an interior space for strength and stability that has an upwardly offset central portion between horizontal portions. The vertical members are preferably I-beams that support a wall height at maximum wind loads. The footer and the header include races for ready wiring without drilling or cutting the vertical members. The system is augmented by mechanical fasteners or adhesives.

6 Claims, 4 Drawing Sheets

PULTRUDED WALL FRAMING SYSTEM

CROSS-REFERENCE TO RELATED APPLICATION

This is a non-provisional application claiming priority to the provisional application with a Ser. No. 60/713,780 which was filed on Sep. 2, 2005 and is owned by the same inventor.

BACKGROUND OF THE INVENTION

This invention relates generally to a structural building system. In particular, the present invention relates to a structural system for withstanding high wind loadings.

The ability of architects, engineers, builders, and contractors to supply quality, affordable houses and buildings that meet customer design demands and satisfy local building codes has become a major challenge using conventional materials and techniques. The high number of hurricanes in 2004 has highlighted the need for structural systems for homes and other buildings which are designed and tested to withstand high winds without structural damage. However, the realities of wind exposure and economics can make a system which is designed for the highest wind loading prohibitively expensive in areas where the wind loads are less severe. While custom engineering of homes for different locations can be expensive, conventional wood stud walls using rectangular studs, sills, and headers have shown their limitations over the last century.

Further need for new construction materials has arisen from the prevalence of mold and the dwindling supply of skilled labor. Problems with black mold and other fungi within buildings, the impact on the health of building occupants, and the infestation of virulent insects, particularly in the south, have created new challenges for wood, the dominant building material. On the other hand, the dwindling number of skilled tradesman in construction has placed significant limits on the use and adoption of other construction materials, primarily steel.

Wood materials have been augmented in recent years with engineered components. The components are selected and assembled to meet specific structural and building code requirements at an affordable price. Along with the performance characteristics of the components, the material of the components resists mold and any efforts by termites and other insects to attack and to infest a structure. Further, the material of the components can self-extinguish any residual combustion once an ignition source is removed.

DESCRIPTION OF THE PRIOR ART

Existing building systems assemble their components in a variety of ways. For example, the patent to Hall, U.S. Pat. No. 3,877,193 discloses a plate-and-stud structural assembly having a plate member that is generally channel-shaped. A stud is positioned in slots, and the stud rests on the shelf portions. The plate member is used both as a footer and a header. Further, tapered pins placed through holes in the web of a stud and the plate member provide the structural rigidity of this building system.

Then the patent to Balinski, U.S. Pat. No. 4,621,470 discloses a runner that supports wallboard panels above a floor surface to prevent the panels from absorbing water and forming mildew. Inner flange members and a platform web create a channel centered below the wallboard. The wallboard sits on the platform web and the upper runner is fairly traditional.

The runner elevates the wallboard but provides minimal structural connection between the runner and the wallboard.

The patent to Hajjar, U.S. Pat. No. 5,020,290 discloses structural elements for constructing interior walls that may be quickly and easily disassembled. Members act as a footer and a header, I-beam shaped vertical members are located in channels of the members, and panels rest on support members. Additionally, the vertical members appear formed from rolled sheet steel or other metal.

The patent to Haag, U.S. Pat. No. 5,74,975 shows a modular building structure, particularly a wall cap. The wall cap has a flat bottom and hollow flanking passageways for cable. In contrast, the header of the present invention has a corrugation in the bottom face for stiffening. However, the panel connector of Haag, identified as 95, has similar shapes as those in the header of the present invention.

Then the patent to Ruff, U.S. Pat. No. 6,079,181 illustrates a header that interlocks with vertical jambs to form a knock-down wall unit. The wall unit supports a combination of panels and doors. The vertical mullions and jambs have a cross section that expands to form the sealing ridge inside a door frame.

And the application to Douglas, No. 2004/0134162 describes a load-bearing structure having numerous configurations for top plates and footers. The structure is primarily a building foundation wall or other below grade wall. For below ground use, the panels and structure are primarily designed for compressive building loads and less so lateral impulse loads from wind.

The present invention overcomes the limitations of the prior art explained above. The building system utilizes I shaped vertical members capped at the top and the bottom with rigid horizontal members. In contrast to the prior art, the art of the present invention provides a building system of readily connected components that withstands loadings from hurricane speed winds.

SUMMARY OF THE INVENTION

In response to hurricane wind loadings and the limited performance of wood at those loadings, the present invention was developed. Generally, the present invention provides standardized materials having novel configurations that provide superior wind resistance, and reduced bending deflection at a competitive price. The present invention of a structural building system has a footer generally at the bottom of a wall, a header distant from the footer, and a plurality of vertical members spanning the footer and the header. The footer has a configuration that includes two support members for additional strength, stability, and torsional stiffness, and the header has a configuration that includes a brace member or corrugation having an upwardly-offset central portion for additional strength, stability, and torsional stiffness. The vertical members fit within the headers and footers to attain a constrained, or "built in", connection that lowers the deflection of a vertical member fivefold for a given loading. The vertical members are preferably I-beams dimensioned for a particular combination of wall height and maximum wind loads along with snow loads and earthquake loads.

Deflection of a beam is generally calculated using the following formula:

Equation 1:

$$Displacement_{max} = \frac{5wl^4}{384EI}$$

where:

w is the uniform load per unit length on the beam l is the length of the beam between supports E is the modulus of elasticity of the beam material I is the section modulus of the beam Deflection of a beam that is constrained on both ends is generally calculated using the following formula:

Equation 2:

$$Displacement_{max} = \frac{wl^4}{384EI}$$

The two formulae have the same variables, as listed above for Equation 1, and differ in the constant. The constant, 5, applied to the variables produces the deflection of an unconstrained beam in Equation 1. Without the constant applied in Equation 2, the deflection is five times less in a constrained beam than in an unconstrained beam. The present invention seeks to capitalize on the lower deflection for a given load using a constrained beam. The present invention uses the depth of sidewalls and existing fasteners and adhesives to constrain the ends of vertical members.

There has thus been outlined, rather broadly, the more important features of the invention in order that the detailed description thereof that follows may be better understood and that the present contribution to the art may be better appreciated.

Further, the present invention also includes variable flange widths on the vertical members, footers and headers that confine the ends of the vertical members against rotation and translation, and a reinforcing corrugation that also functions as a cable raceway.

The present invention addresses the performance and economic needs of the construction industry. When the performance characteristics of the components of the present invention combine into a building system, architects and engineers have the flexibility of various wall heights for a structure and creating a structure with the integrity and strength to endure the loads that are imposed at the specific building site. Contractors can use existing hand tools, common fasteners, construction adhesives, or alternatively welding, and minimal supervision of crew to assemble the light weight components of the present invention. When assembled, the components of the present invention have physical characteristics that eliminate the need for interior load bearing walls in typical residential designs. The present invention provides architects, engineers, and contractors heightened flexibility and more control on interior room layouts.

Numerous objects, features and advantages of the present invention will be readily apparent to those of ordinary skill in the art upon a reading of the following detailed description of the presently preferred, but nonetheless illustrative, embodiment of the present invention when taken in conjunction with the accompanying drawings. Before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, the phraseology and terminology employed herein are for the purpose of description and should not be regarded as limiting.

It is, therefore, a principal object of this invention to provide a structural building system that can withstand high wind loadings.

Another object of this invention is to provide a structural building system that meets building codes particularly hurricane speed wind loadings and drifting snow loads.

Another object of this invention is to provide a structural building system that uses standardized materials instead of materials specifically engineered for a single project.

Another object of this invention is to provide a structural building system that uses a header and footer along with vertical members, all selected from a set of a dimensioned and engineered components to meet the specifications of a construction project.

Still another object of this invention is to provide a structural building system that includes vertical members made as a single piece that can be finish cut to accommodate a specified wall height.

Still another object of this invention is to provide a structural building system that resists mold appearance and growth, stalls termite attacks, and repels insect infestations.

Still another object of this invention is to provide a structural building system that ceases combustion and extinguishes any remaining fire upon a component of the system when a fire ignition source is removed.

Still another object of this invention is to provide a structural building system that assembles readily by semi-skilled workers using existing hand tools, common fasteners, and adhesives.

Yet another object of this invention is to provide a structural building system that is cost effective for manufacturing and installation.

A further object of this invention is to provide a structural building system that creates races for ready wiring without drilling through or cutting into the vertical members of the system.

A further object of this invention is to provide a structural building system that accepts existing external and internal finishing techniques and materials.

Lastly it is an object of this invention is to provide a structural building system that connects with roofing systems such as those made from composites, ceramics, and metal or wooden trusses.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated a preferred embodiment of the invention.

BRIEF DESCRIPTION OF THE DRAWINGS

The same reference numerals refer to the same parts throughout the various figures.

DESCRIPTION OF THE PREFERRED EMBODIMENT

Figure 8:
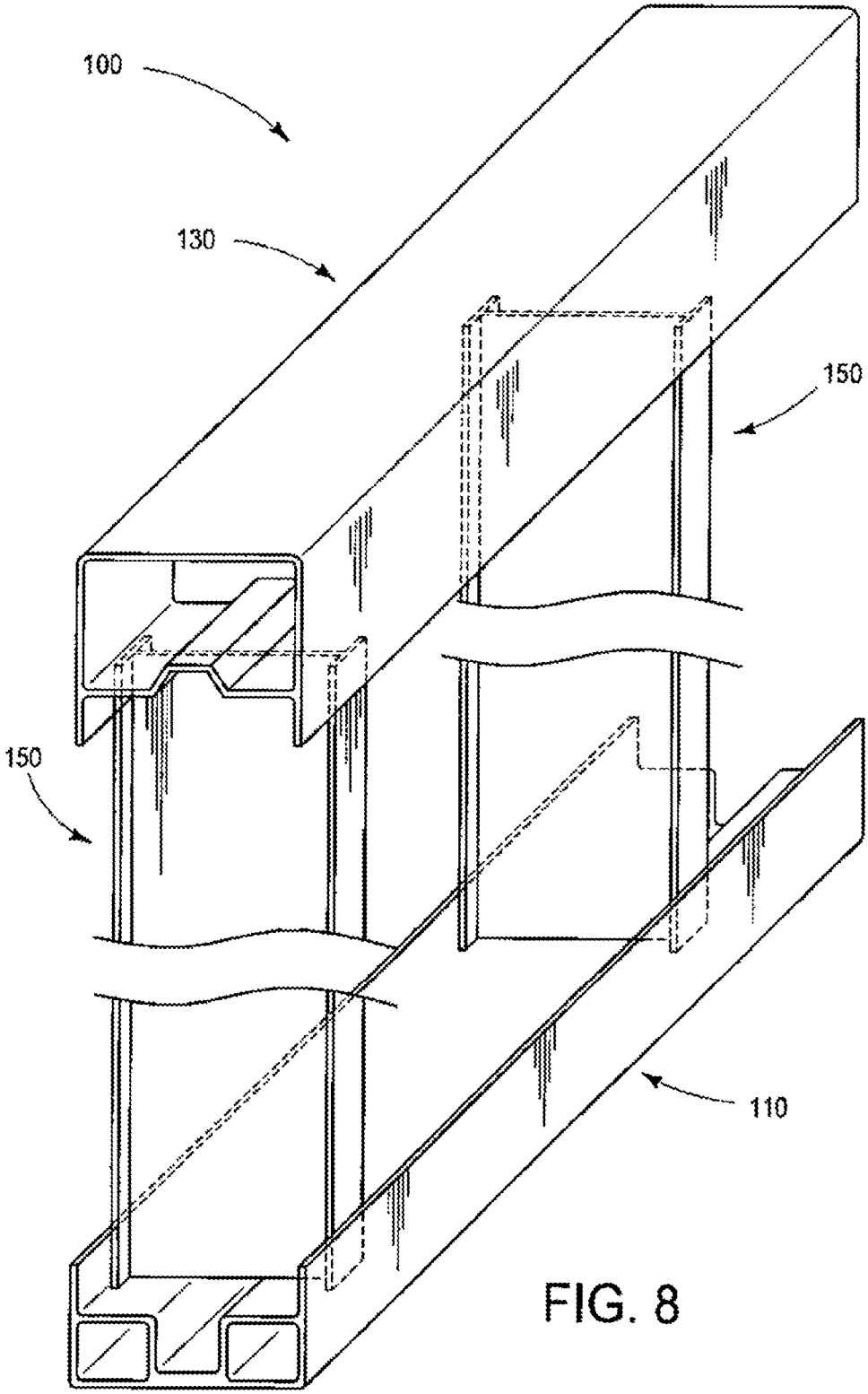

The present art overcomes the prior art limitations by having a vertical member constrained against rotation at both ends. A structural building system according to the present invention will now be described in detail with reference to FIGS. 1 through 8 of the accompanying drawings. When assembled into a wall structure, as shown in FIG. 8, a structural building system 100 has a footer 110, a header 130 distant from and generally parallel to the footer 110, and a plurality of vertical members 150 spanning the footer 110 and the header 130. The footer, header, and vertical members are each manufactured as a single piece. Each piece is pultruded through a single die as a continuous part.

Figure 1:
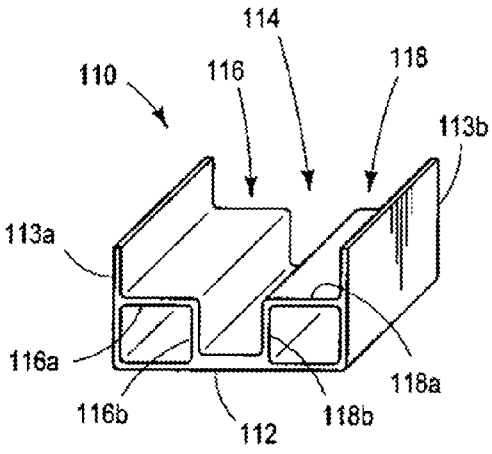
FIG. 1 is a perspective view of a header according to the current invention.

The footer 110 has a bottom wall 112 attached to first and second opposed sidewalls 113*a*, 113*b* that collectively define a footer interior space 114 as shown in FIG. 1. The first and second opposed sidewalls 113*a*, 113*b* are preferably perpendicular to the bottom wall 112. First and second support members 116, 118 are positioned in the interior space 114 to add strength and stability to the footer 110 and the building system 100. These support members 116, 118 allow the footer 110 to withstand high torsional and bending loads, providing superior wind resistance over the prior art. While the footer 110 is preferably a fiberglass composite structure manufactured using pultrusion technology, other manufacturing processes and materials may be used.

The first support member 116 has a horizontal portion 116*a* that is attached to the first sidewall 113*a* and a vertical portion 116*b* that is attached to the bottom wall 112. The second support member 118 is preferably a reflection of the first support member 116 and includes a horizontal portion 118*a* attached to the second sidewall 113*b* and a vertical portion 118*b* attached to the bottom wall 112. The first sidewall 113*a* preferably extends upwardly beyond the first support member horizontal portion 116*a*, and the second sidewall 113*b* preferably extends upwardly beyond the second support member horizontal portion 118*a*. The first support member horizontal portion 116*a* preferably does not abut the second member horizontal portion 118*a*, and both horizontal portions 116*a*, 118*a* preferably have a length approximately one-third as long as a length of the footer bottom wall 112. Both horizontal portions 116*a*, 118*a* are preferably of equal length for force distribution purposes.

Figure 2:
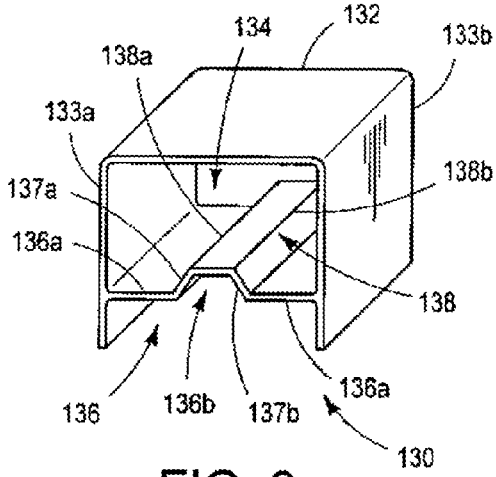
FIG. 2 is a perspective view of a header according to the current invention.

The header 130 includes a top wall 132 attached to first and second opposed sidewalls 133*a*, 133*b* that collectively define a header interior space 134 here shown in FIG. 2. The first and second header sidewalls 133*a*, 133*b* are preferably perpendicular to the top wall 132. At least one corrugation or brace member 136 is positioned in the header interior space 134 and attached to the first and second header sidewalls 133*a*, 133*b* to add strength and stability to the header 130 and the building system 100. This brace member 136 allows the header 130 to withstand high torsional and bending loads, providing superior wind resistance over the prior art. Both the first and second sidewalls 133*a*, 133*b* preferably extend downwardly beyond the brace member 136 and thus provide load bearing characteristics for the header. While the header 130 is preferably a fiberglass composite structure manufactured using pultrusion technology, other manufacturing processes and materials may be used.

The brace member 136 includes an upwardly-offset central portion 136*b* between two generally-horizontal portions 136*a*. The upwardly-offset central portion 136*b* includes first and second planar sections 137*a*, 137*b* and a generally-horizontal planar section 138 having first and second sides 138*a*, 138*b*. The first planar section 137*a* is attached to the first side 138*a* of the generally-horizontal planar section 138 at an obtuse angle and attached to a generally-horizontal portion 136*a* at an obtuse angle. The second planar section 137*b* is attached to the second side 138*b* of the generally-horizontal planar section 138 at an obtuse angle and attached to a generally-horizontal portion 136*a* at an obtuse angle. The first and second planar sections 137*a*, 137*b* are preferably of equal length, and the first planar section 137*a* is preferably attached to the generally-horizontal planar section first side 138*a* at the same obtuse angle that the second planar section 137*b* attaches to the generally-horizontal planar section second side 138*b*.

Figure 3:
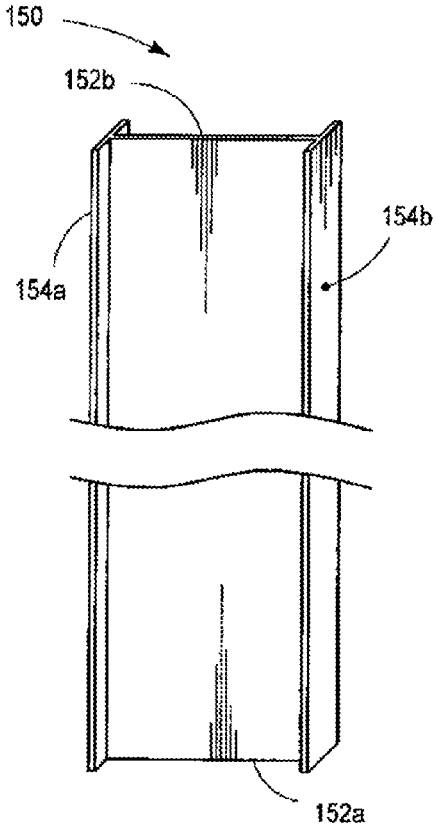
FIG. 3 is a perspective view of a vertical member according to the current invention.
Figure 4:
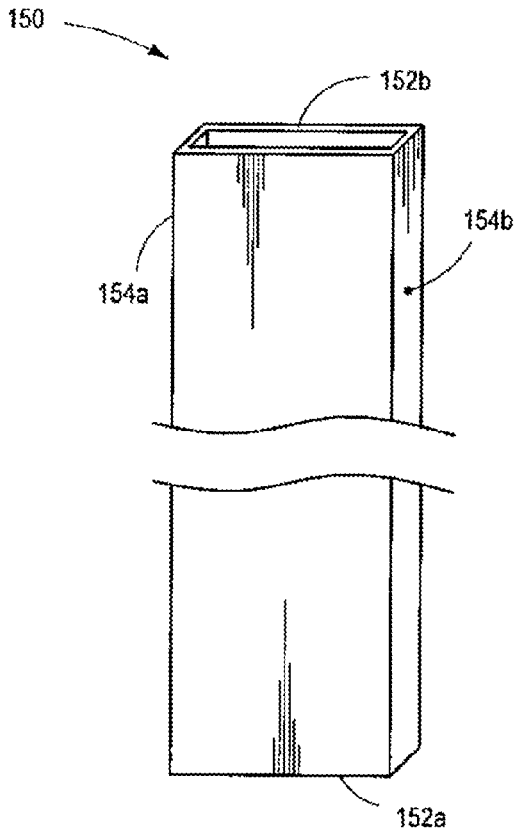
FIG. 4 is a perspective view of another vertical member according to the current invention.
Figure 5:
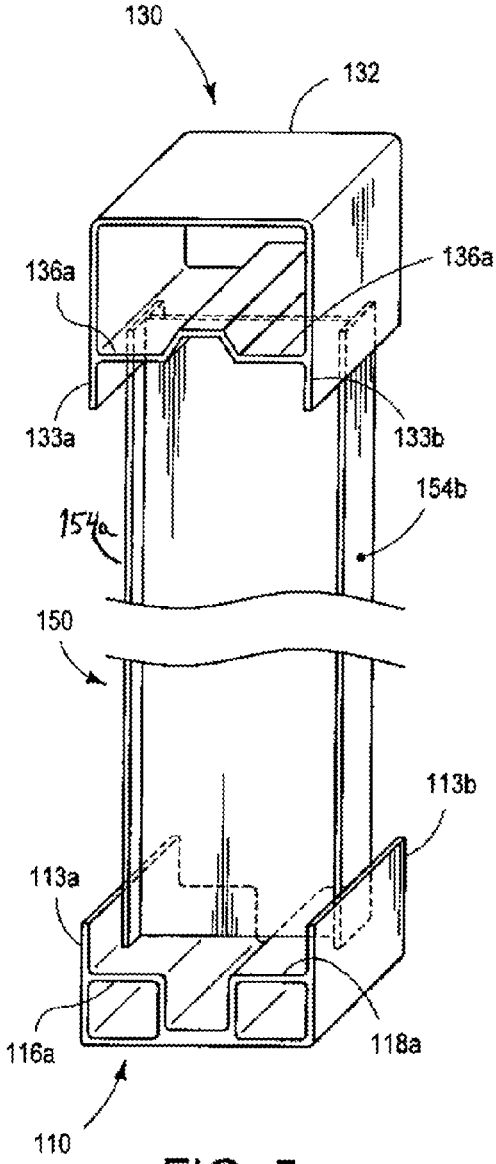
FIG. 5 is a perspective view of a structural building system according to the current invention.
Figure 6:
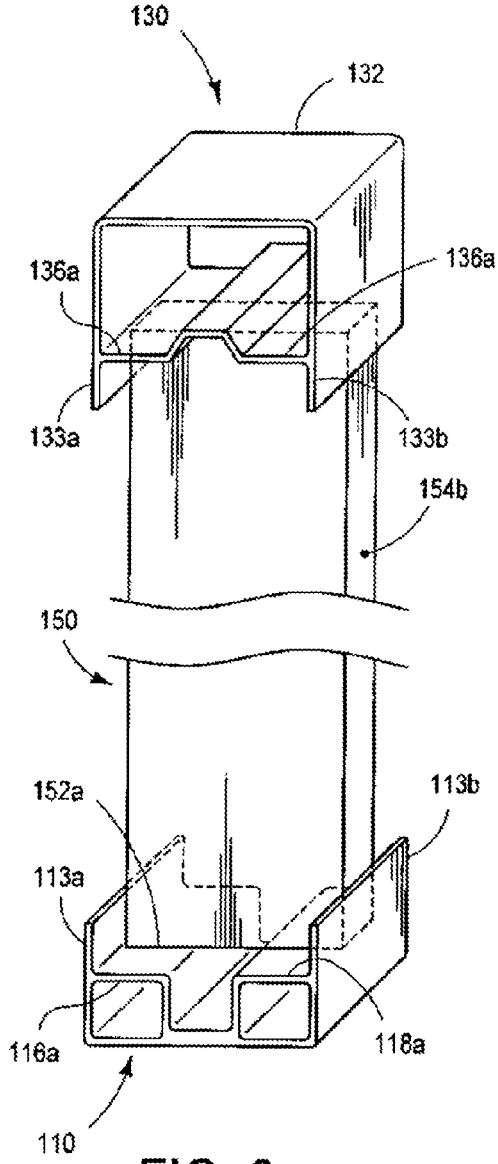
FIG. 6 is a perspective view of another embodiment of the structural building system according to the current invention.
Figure 7:
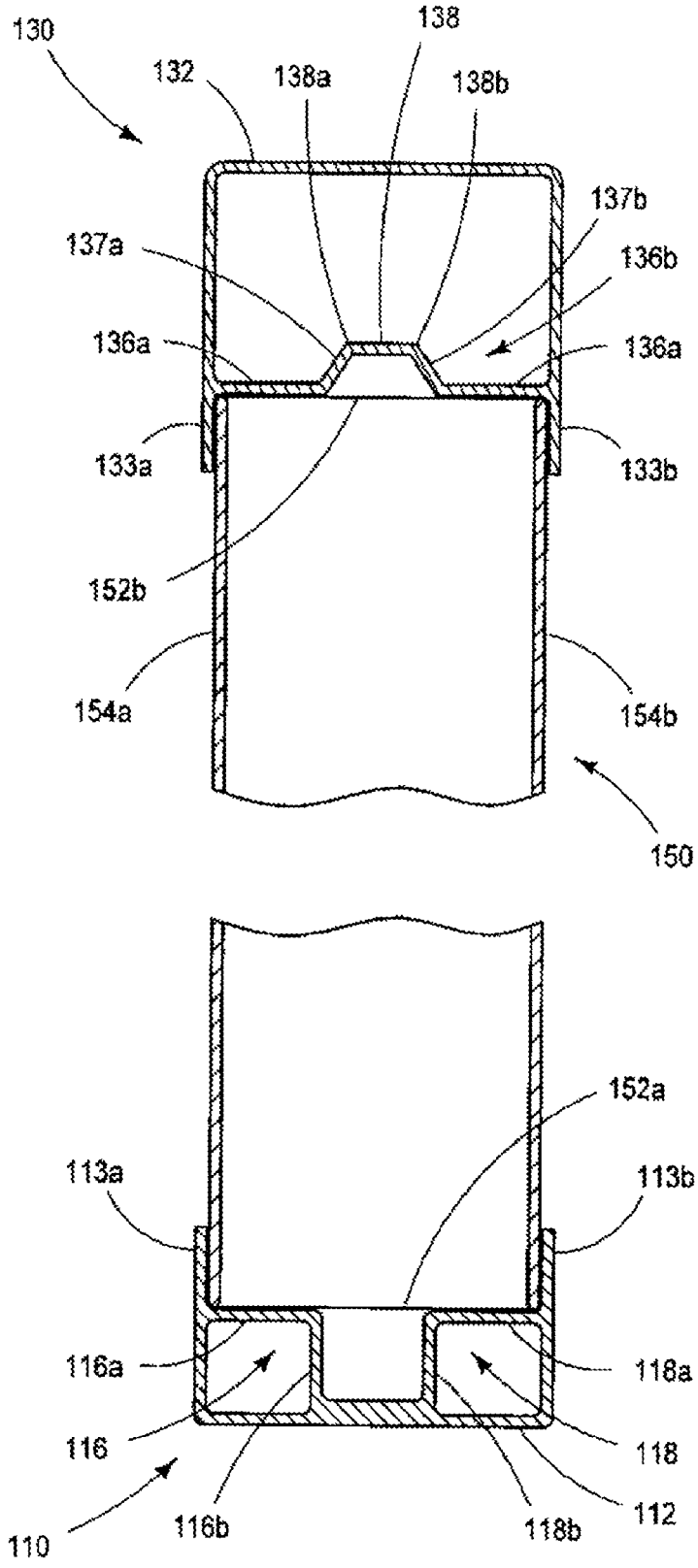
FIG. 7 is a cross-sectional view of the structural building system as in FIG. 5; and, FIG. 8 is a perspective view of the structural building system as in FIG. 5.

Each vertical member 150 presents a bottom end 152*a*, a top end 152*b*, a first flange 154*a*, and a second flange 154*b*, and each vertical member 150 is preferably an I-beam dimensioned for a particular combination of wall height and maximum wind loads (FIG. 3). It is understood, however, that other vertical members 150 may be used with the footer 110 and the header 130, including traditional rectangular studs, for example.

In use, the bottom end 152*a* of each vertical member 150 sits atop the first and second support member horizontal portions 116*a*, 118*a*, and the top end 152*b* of each vertical member 150 abuts the brace member generally-horizontal portions 136*a* (FIGS. 5 through 8). Each first flange 154*a* abuts the portion of the footer first sidewall 113*a* that extends upwardly beyond the first support member horizontal portion 116*a*, and each first flange 154*a* abuts a portion of the header first sidewall 133*a* that extends downwardly beyond the brace member 136. Each second flange 154*b* abuts the portion of the footer second sidewall 113*b* that extends upwardly beyond the second support member horizontal portion 118*a*, and each second flange 154*b* abuts a portion of the header second sidewall 133*b* that extends downwardly beyond the brace member 136.

The vertical members 150 are preferably fastened to the footer 110 and the header 130 with readily installed self-tapping screws, or other mechanical fasteners, or alternatively adhesives or welding. The self-tapping screws or fasteners provide a mechanical constraint against movement of each end of the vertical members. Alternatively, adhesives bond the vertical members to the header and to the footer without drilling therethrough. Also, while the vertical members 150 preferably meet the footer 110 and the header 130 perpendicularly, it should be understood that vertical members 150 may meet the footer 110 and the header 130 at other angles.

The placement, or second constraint, of the first and second flanges 154*a*, 154*b* against the sidewalls 113*a*, 133*a*, 113*b*, 133*b* further reinforces the footer 110, the header 130, and the vertical members 150, and thereby increases bending resistance under wind loading and reduces deflection of a wall from the loading. The vertical members effectively fit within the sidewalls similar to a sleeve. The length of the flanges against the sidewalls further constrains the ends of the vertical members in cooperation with the mechanical fasteners, or alternatively adhesives. Generally, the length of flanges constrained provides the primary deflection resistance while the mechanical fasteners, or alternatively adhesives, resist racking of the invention when assembled into a wall and provide secondary constraint of the ends of the vertical members.

Because the amount of contact between the first and second flanges 154*a*, 154*b* with the footer 110, and the header 130 affects the amount of deflection induced by loads from wind speeds of approximately 60 mph to approximately 180 mph, the vertical members 150 have been engineered with flanges 154*a*, 154*b* of approximately 1.0 inches to approximately 4.0 inches wide. The flanges 154*a*, 154*b* also have a thickness of approximately 0.25 inches to approximately 0.875 inches. In use, the specific size of the vertical members 150 with flanges 154*a*, 154*b* is selected from a table of engineering data produced once the invention is manufactured in large quantities. The table correlates the performance of the present invention with environmental conditions in general. In particular, the table relates parameters, such as wall height and stud spacing, to loadings especially wind load. A governing parameter of the table is the deflection of a wall at a given load. Generally, the present invention meets L/240 deflection at hurricane force winds where L represents the span in inches and 240 is the divisor representing a one inch deflection at twenty feet of span. Masonry walls generally withstand L/240 deflection with limited if any cracking.

From testing in the laboratory and small scale field experiments, vertical members 150 with flange sizes of approximately 2.0 inches to approximately 3.0 inches meet the deflection criteria of building codes in high wind areas. On the other hand, vertical members 150 with flange sizes of approximately 1.0 inches to approximately 2.0 inches meet the deflection criteria of building codes in low or minimal wind areas. Minimal wind areas are generally located inland, approximately 120 miles from a sea coast.

Simulations and experiments have shown walls constructed using the structural building system 100 to have excellent deflection performance for high wind loading due to the novel configurations of the footer 110 and the header 130 as described above, as well as the above-described positioning of the vertical members 150 between the footer 110 and the header 130.

Additionally, the first and second support members 116, 118 and the brace member 136 create races for easy wiring without drilling through the vertical members.

Additionally, the structural building system when arranged horizontally, as in a roof, withstands uplift forces from hurricane speed winds. Positioned horizontally, the present invention also supports snow drifts at least four inches deep and at least two feet wide. Additionally, vertical loading upon a roof, when transmitted through the present invention as a wall, increases the torsional resistance of the header and footers resulting in lower deflection. A vertical load on the present invention as a wall further constrains the ends of the vertical members thus limiting wall deflection even more. Further, the present invention can be installed in a multiple story building where the weight of present invention from stories above stiffens the footer and header of a given elevation.

The structural system 100 is cost-effective because assembly of the present invention calls for semi-skilled labor, existing hand tools for applying common fasteners or adhesives, and standardization of connections and joints. The components of the present invention assemble readily with the vertical members having flange widths selected for specific building codes and loadings induced by the environment, particularly wind loads.

From the aforementioned description, a structural building system has been described. The system is uniquely capable of constraining the ends of vertical members to reduce deflection in half at high wind loadings. The structural system and its various components may be manufactured from many materials, including but not limited to, glass and polyester composite, polymers, rugged plastics, engineered wood, wood and resin formulations, ferrous and non-ferrous metals and their alloys, and composites. The common fasteners include but are not limited to self tapping screws, bolts, rivets, and snap fittings. The adhesives include but are not limited to water, silicone, and resin based glues, adhesives, and caulks.

As such, those skilled in the art will appreciate that the conception, upon which this disclosure is based, may readily be utilized as a basis for the designing of other structures, methods and systems for carrying out the several purposes of the present invention. Therefore, the claims include such equivalent constructions insofar as they do not depart from the spirit and the scope of the present invention.

I claim:

1. A wall system, comprising:

a single piece footer;

a single piece header distant from said footer;

a plurality of vertical members spanning said footer and said header;

said footer having a bottom wall attached to first and second opposed sidewalls defining an interior space generally in a U shape; a first support member positioned in said interior space and having a horizontal portion attached to said first sidewall and a vertical portion attached to said bottom wall; and, a second support member positioned in said interior space and having a horizontal portion attached to said second sidewall and a vertical portion attached to said bottom wall;

each of said vertical members having a bottom end and an opposite top end, each of said bottom ends sitting atop the horizontal portions of said first support member and said second support member without contacting said bottom wall and fitting snugly within said first sidewall and said second sidewall and thus, constraining said bottom end against rotation;

each of said vertical members having a first face and a second face;

each of said first faces abutting a portion of the first sidewall of said footer that extends upwardly beyond said first support member horizontal portion;

each of said second faces abutting a portion of the second sidewall of said footer that extends upwardly beyond the horizontal position of said second support member;

wherein said header includes a top wall attached to first and second opposed header sidewalls defining a header interior space; and a brace member positioned in said header interior space and joined to said first and second header sidewalls as a single piece, said brace member having an upwardly-offset central portion between two generally-horizontal portions wherein said central portion extends into said header towards said top wall and wherein said vertical members abut said brace member.

2. A wall system, comprising:

a single piece footer;

a single piece header distant from said footer;

a plurality of vertical members spanning said footer and said header;

said header including:

a top wall joined to first and second opposed sidewalls defining an interior space;

a brace member positioned in said interior space and joined to said first and second header sidewalls as a single piece away from said top wall, said brace member having an upwardly-offset central portion between two generally horizontal portions wherein said central portion extends into said header and wherein said vertical members abut said brace member without contacting said central portion;

wherein said upwardly-offset central portion includes a generally horizontal planar section generally parallel to said top wall having first and second sides;

a first planar section attached to said generally-horizontal planar section first side at an obtuse angle and attached to one said generally-horizontal portion at an obtuse angle;

a second planar section attached to said generally-horizontal planar section second side at an obtuse angle and attached to another said generally-horizontal portion at an obtuse angle;

wherein said first planar section and said second planar section are of equal length;

said first planar section attaches to said generally horizontal planar section first side at the same obtuse angle that said second planar section attaches to said generally horizontal planar section second side;

wherein said footer includes a bottom wall connected to first and second opposed footer sidewalls defining a footer interior space and said bottom wall having a length between said first footer sidewall and said second footer sidewall;

a first support member positioned in said footer interior space and having a horizontal portion connected to said first footer sidewall and a vertical portion connected to said bottom wall;

a second support member positioned in said footer interior space and having a horizontal portion connected to said second footer sidewall and a vertical portion connected to said bottom wall;

wherein said first support member and said second support member have single piece construction with said footer; and, adhesively connecting said vertical members interiorly of said footer and interiorly of said header;

wherein said first support member combined with said second support member occupy less than the length of said bottom wall.

3. The wall system as in claim 2 wherein each of said vertical member has a bottom end and a top end, each of said bottom end sitting atop said first and second support member horizontal portions without contacting said bottom wall, each of said top end abutting said brace member generally-horizontal portions;

each of said vertical members has first and second faces;

each of said first faces abuts a portion of said footer first sidewall that extends upwardly beyond said first support member horizontal portion;

each of said first faces abuts a portion of said header first sidewall that extends downwardly beyond said brace member;

each of said second faces abuts a portion of said footer second sidewall that extends upwardly beyond said second support member horizontal portion;

each of said second faces abuts a portion of said header second sidewall that extends downwardly beyond said brace member.

4. A wall system for withstanding high wind loads, comprising:

at least one elongated footer having at least one hollow interior space;

at least one elongated header, mutually parallel and spaced apart from said footer, having at least one hollow interior space; and, a plurality of single piece generally vertical members extending from said footer to said header, said vertical members seating within said footer and said header thereby being constrained against rotation, said vertical members having at least two mutually parallel and spaced apart flanges, said flanges having a width from approximately one inch to approximately four inches and a thickness from approximately one quarter of an inch to approximately seven eighths of an inch, wherein the width and thickness of said flanges provide no more than L/240 deflection in bending of said system when said system is subject to hurricane speed winds;

adhesively connecting said vertical members interiorly of said footer and interiorly of said header; and, wherein said vertical members abut said footer incompletely and said vertical members abut said header incompletely.

5. The wall system of claim 4 further comprising:

said footer having a somewhat U shape, a bottom wall, two mutually parallel and spaced apart sidewalls perpendicular to said bottom wall, and two spaced apart and coplanar support members generally parallel to and spaced above said bottom wall and attaching to said sidewalls; and, each of said vertical members having a bottom end and a top end, each of said bottom ends sitting upon said support members, and fitting snugly within said sidewalls thus, constraining each of said bottom ends against rotation.

6. The wall system of claim 4 further comprising:

said header having a somewhat box shape, a top wall, two mutually parallel and spaced apart sidewalls depending from and perpendicular to said top wall, said top wall and said sidewalls defining an interior space, and a brace member mutually parallel to and spaced below said top wall and attaching to said sidewalls, said brace member having at least one corrugation mutually parallel and spaced below said top wall, said at least one corrugation extending upwardly towards said top wall, said corrugation stiffening said header and providing a raceway for utilities wherein said at least one corrugation extends into said brace member and wherein said vertical members abut said brace member without contacting said at least one corrugation; and, each of said vertical members having a bottom end and a top end, each of said top ends abutting said brace member, and fitting snugly within said sidewalls and thus, constraining said top end against rotation.

* * * * *